US005242563A

United States Patent [19]

Stern et al.

[11] Patent Number: 5,242,563

[45] Date of Patent: Sep. 7, 1993

[54] MOLTEN SALT REACTOR FOR POTENTIOSTATIC ELECTROPLATING

[75] Inventors: Kurt H. Stern, Takoma Park, Md.; Ralph M. Hess, Victoria, Australia

[73] Assignee: The United States of America as represented by the Secretary of the Navy, Washington, D.C.

[21] Appl. No.: 850,107

[22] Filed: Mar. 12, 1992

[51] Int. Cl.[5] ..... C25C 3/00; C25D 17/00

[52] U.S. Cl. ..... 204/241; 204/244; 204/246; 204/247

[58] Field of Search ..... 204/241, 246, 247, 244

[56] References Cited

U.S. PATENT DOCUMENTS

| | | | |
|---|---|---|---|
| 1,004,673 | 10/1911 | Monnot | 204/246 X |
| 1,323,936 | 12/1919 | Weaver | 204/247 X |
| 1,905,866 | 4/1933 | Heany | 204/64 R |
| 2,398,590 | 4/1946 | Mitchell | 204/245 |
| 2,952,591 | 9/1960 | Finn, Jr. et al. | 204/246 X |
| 3,024,174 | 3/1962 | Stetson | 204/39 |
| 3,083,153 | 3/1963 | Wagner | 204/246 |
| 3,126,327 | 3/1964 | Fleck et al. | 204/71 |
| 3,453,187 | 7/1969 | Slatin | 204/246 X |
| 3,691,031 | 9/1972 | Lugscheider | 204/39 |
| 4,033,846 | 7/1977 | Engesland | 204/247 |
| 4,430,170 | 2/1984 | Stern | 204/39 |
| 4,662,998 | 5/1987 | Stern | 204/39 |
| 4,699,704 | 10/1987 | Ishizuka | 204/243 R |
| 4,995,948 | 2/1991 | Poa et al. | 204/241 X |
| 5,076,902 | 12/1991 | Joshima et al. | 204/241 |

*Primary Examiner*—Donald R. Valentine

*Attorney, Agent, or Firm*—Thomas E. McDonnell; Barry A. Edelberg

[57] ABSTRACT

A molten salt reactor for potentiostatic electroplating that includes a reactor chamber defined by a peripheral wall, a bottom wall and a top cover. The bottom wall of the reactor chamber has an opening, to which a first end of a gas inlet conduit is attached so as to be in fluid communication with the reactor chamber. A crucible support platform is positioned within the reactor chamber, and a crucible for holding a molten salt is mounted thereon. A furnace substantially surrounds the peripheral wall of the reactor chamber and the first end of the gas inlet conduit. The crucible support platform is electrically insulated from the reactor chamber. An inert gas flows from the gas inlet conduit, through a lower portion of the reactor chamber, past the crucible support platform, through an upper portion of the reactor chamber, and to a gas outlet in the upper portion of the reactor chamber. The inert gas is heated within the first end of the gas inlet conduit prior to flowing into the lower portion of the reaction chamber.

15 Claims, 1 Drawing Sheet

MOLTEN SALT REACTOR FOR POTENTIOSTATIC ELECTROPLATING

FIELD OF THE INVENTION

This invention relates to an apparatus for electrodeposition and, more particularly, to a molten salt reactor for potentiostatic electroplating.

DESCRIPTION OF THE RELATED ART

The advantages which greater hardness in metals offer are well recognized. Harder metals, which are more resistant to wear, reduce the need for frequent and costly replacement of parts.

Abrasive wear afflicts all manner of machinery in which metal surfaces contact other surfaces. For example, erosive wear plagues metal exposed to high velocity gas streams carrying hard particles, as in coal gassification, or even low velocity, liquid-entrained coal particles in a slurry flowing through a pipeline. The wearing of metals is frequently aggravated by high temperatures which lead to simultaneous metal oxidation, particularly in the newer energy industries.

Several approaches to reducing wear have been taken. Chief among these have been the formulation of even harder alloys, such as those based on cobalt. Another route has been to modify only surface properties, rather than the bulk of the metal. This has been done by covering the bulk metal with a coating of another alloy. Still another method has been to modify the surface layer of the metal either by diffusing other metals into the surface (metalliding), by ion implantation, or by laser melting.

It has long been recognized that refractory silicides and carbides possess precisely the desirable hardness missing from metals and are stable at high temperatures. Nevertheless, such refractory silicides and carbides lack the desirable ductility of metals. Consequently, there have been many attempts to combine the two to gain hardness combined with ductility. One approach has been to produce silicide and carbide coatings on metals. However, existing coating methods have not been entirely successful. Plasma spraying, which involves impinging the silicide or carbide powder on the surface to be coated, requires temperatures near 1500° C., use line-of-sight spraying and tends to produce somewhat porous coatings. Chemical vapor deposition can be carried out by combining two reactive gases so that the silicide or carbide reaction product is produced as a coating. Much development has been done on this process, but the coatings are usually quite thin. Further, neither plasma spraying nor chemical vapor deposition allows any control over the stoichiometry of the coating.

In previous studies of the electrochemical reduction, carbides were deposited from melts containing alkali metal fluorides in $B_2O_3$; and wherein metal and carbon are introduced as an oxide and a carbonate, respectively. This method of electrolysis results in the formation of millimeter-size crystals on the walls of the graphite crucible which serves as the cathode. Analysis of these crystals shows that their composition varies with the metal oxide/carbonate ratio in the melt. However, no adherent coating of carbide is formed.

During the 1960's, Senderoff and Mellors in "Coherent Coatings of Refractory Metals" *Science* (1966) vol. 153, pp. 1475–1481, incorporated herein by reference, showed that excellent coatings of refractory metals could be electroplated from the ternary eutectic of (Li, Na, K)F by adding the metal as a complex fluoride, and plating between the appropriate metal anode and the cathode to be plated at 750° C.–800° C. Dense, adherent and ductile plates were obtained, and there seemed to be no upper limit to the plating thickness. In fact, the substrate could be dissolved away to produce free standing refractory metal objects. However, the inventors pointed out that not only halides other than fluoride, but also oxyanions must be absent for the process to be satisfactory.

Silicide coatings on metal articles have been formed by metalliding as disclosed in U.S. Pat. No. Re. 25,630 to Cook. In the metalliding process, silicon is added to a fused complex metal salt bath as silicofluoride. The silicon is dissolved in the bath and the metal article to be coated is immersed in the bath. The silicon diffuses into the metal and reacts with the metal to form a silicide coating. This process forms a non-uniform coating wherein the concentration of silicon is the highest at the surface of the metal. In addition, the rate at which the silicon diffuses into the metal decreases with time, the result of which is that the process slows down as the thickness of the coating increases.

Refractory metal carbide coatings have been electrodeposited as disclosed in U.S. Pat. No. 4,430,170, to Stern, incorporated herein by reference. Hard adherent coatings of any desired thickness were formed. The process comprises adding the refractory metal as a complex fluoride and the carbon as an alkali carbonate to an alkali fluoride melt. An anode comprised of the refractory metal and a cathode comprised of the article to be coated are immersed in the melt. When a voltage is applied across the cathode and anode, the carbon and metal cations are simultaneously reduced at the cathode to form a refractory metal carbide coating. By this process, coatings such as tungsten carbide and tantalum carbide having a desired stoichiometric composition may be deposited on the article to be coated.

Refractory metal silicides have been electrodeposited as disclosed in U.S. Pat. No. 4,662,998, to Stern, incorporated herein by reference. Hard adherent coatings of any desired thickness were formed. The process comprises adding the refractory metal as a complex fluoride and the silicon as a silicon fluoride to an alkali fluoride melt. An elemental form of silicon or the refractory metal is placed in the melt as the anode. The article to be coated is placed into the melt as the cathode. A platinum wire is placed into the melt as the reference electrode. Electrolysis is carried out potentiostatically in the traditional manner, i.e., voltage is applied across the reference electrode and the cathode until the article has the desired coating thickness. The silicon and metal cations are simultaneously reduced at the cathode to form the refractory metal silicide coating. By this process, coatings such as tantalum silicide and titanium silicide having a desired stoichiometric composition may be deposited on the surface of the object to be coated.

However, problems are encountered when the electrodeposition processes respectively disclosed in U.S. Pat. Nos. 4,430,170 and 4,662,998 are scaled-up beyond laboratory-scale conditions. The electrodeposition processes disclosed in these patents work well under laboratory-scale conditions, such as in a glove box, but the following problems are encountered in scale-up: 1) electrical conduction between the salt melt container and the walls of the reactor chamber prevents potentiostatic plating due to metal-metal contact; and 2) condensation of vaporizing molten salt within the hot zone of the reactor chamber also prevents potentiostatic plating by providing a conducting path, even in the absence of metal-metal contact.

SUMMARY OF THE INVENTION

It is therefore an object of the present invention to scale-up the electrodeposition processes such as disclosed in U.S. Pat. Nos. 4,430,170 and 4,662,998 from glove box-sized apparatus to pilot plant stage or larger, while overcoming the above-noted problems.

A further object of the present invention is to provide a large-scale molten salt reactor for potentiostatic electroplating, which produces a hard, dense, adherent coating of refractory metal carbides and silicides.

A still further object of the present invention is to provide a large-scale molten salt reactor for potentiostatic electroplating, which produces coatings of refractory metal carbides and silicides of virtually any desired thickness.

Yet another object of the present invention is to provide a large-scale molten salt reactor for potentiostatic electroplating of refractory metal carbides and silicides, whereby the stoichiometry of the metal carbide and silicide coatings produced can be controlled.

These and other objects of the present invention are achieved by a molten salt reactor for potentiostatic electroplating that includes a reactor chamber defined by a peripheral wall, a bottom wall and a top wall. The bottom wall of the reactor chamber has an opening, to which a first end of a gas inlet conduit is attached, so as to be in fluid communication with the reactor chamber. A crucible support platform is positioned within the reactor chamber, and a crucible for holding a molten salt is mounted thereon. A furnace substantially surrounds the peripheral wall of the reactor chamber and the first end of the gas inlet conduit. The crucible support platform is electrically insulated from the reactor chamber. An inert gas sequentially flows from the gas inlet conduit, through a lower portion of the reactor chamber, past the crucible support platform, through an upper portion of the reactor chamber, and to a gas outlet in the upper portion of the reactor chamber. The inert gas is heated within the first end of the gas inlet conduit prior to flowing into the lower portion of the reaction chamber. These and other features and advantages of the present invention will become more apparent with reference to the following description of the preferred embodiment and drawing. However, the drawing and description are merely illustrative in nature and not restrictive.

BRIEF DESCRIPTION OF THE DRAWINGS

The accompanying drawing illustrates several aspects of the present invention, and together with the description serves to explain the principles of the present invention.

DESCRIPTION OF THE PREFERRED EMBODIMENTS

Figure 1:
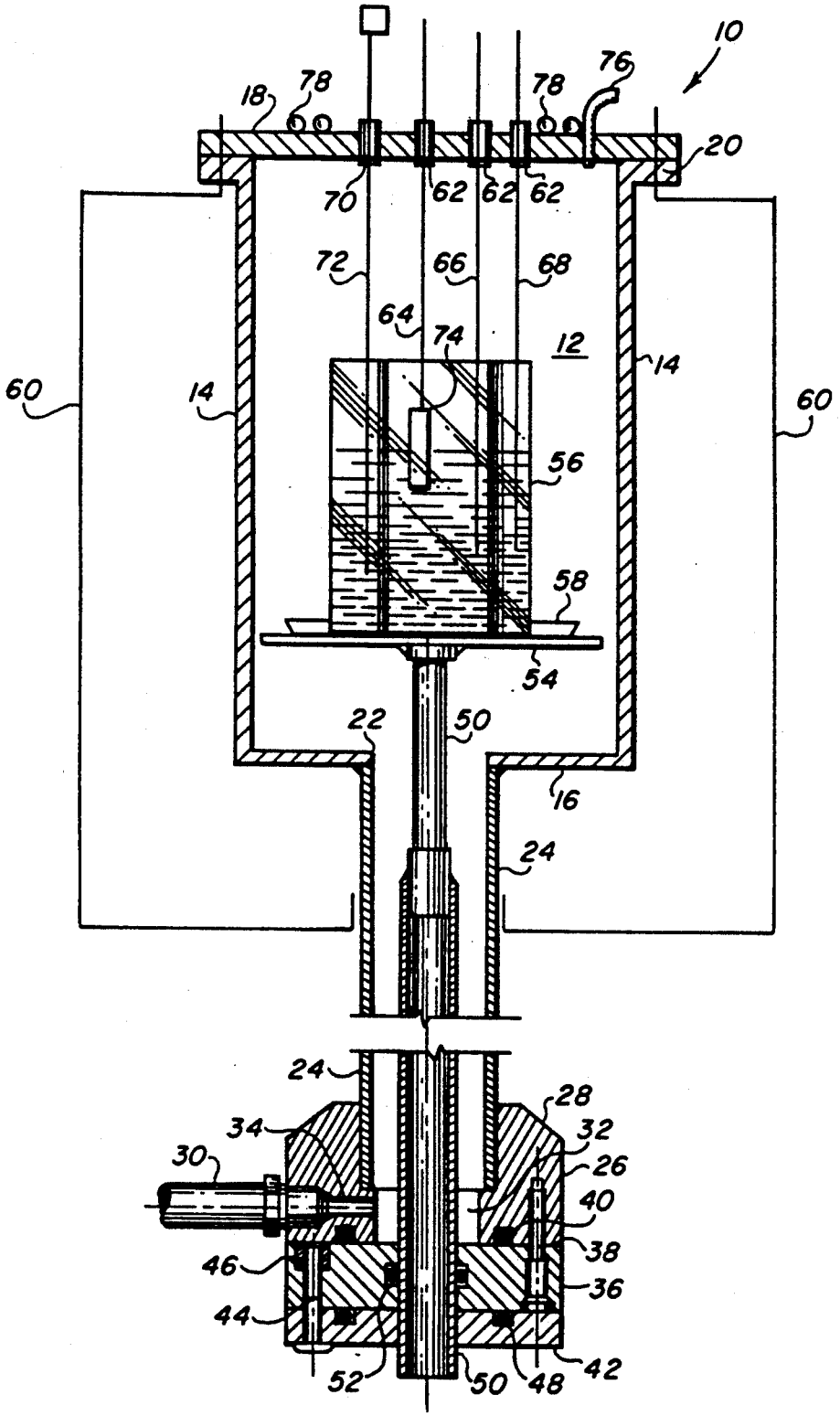
FIG. 1 is a partial sectional view of a molten salt reactor for potentiostatic electroplating according to the present invention.

FIG. 1 shows a partial sectional view of a molten salt reactor 10 according to the present invention. A reactor chamber 12 is defined by a peripheral wall 14, a bottom wall 16 and a cover 18, which are made of a high-temperature corrosion resistant material, such as "INCONEL", which is a trade name for a nickel-based alloy containing 16% chromium and 7% iron. Peripheral wall 14 may be in the form of a cylinder and includes a flange 20, to which cover 18 is removably attached by, for example, bolting, in order to seal reaction chamber 12. An "O" ring (not shown) made of rubber, for example, may be interposed between flange 20 and cover 18 to provide a better seal.

Bottom wall 16 includes an opening 22 concentric with peripheral wall 14. A gas inlet conduit 24 is attached to bottom wall 16, so that gas inlet conduit 24 is in fluid communication with reactor chamber 12 through opening 22. Gas inlet conduit 24 and bottom wall 16 are sealed to one another by, for example, welding, brazing, or the like. Gas inlet conduit 24 may be made of any high-temperature corrosion resistant material, for example, "INCONEL".

Gas inlet conduit 24 terminates in a coupling 26, which includes a boss 28 and a lateral gas inlet 30. Gas inlet conduit 24 is sealed to boss 28 by, for example, an interference (friction) fit, welding, brazing, or the like. Boss 28 includes an aperture 32 concentric with gas inlet conduit 24, and an aperture 34 lateral to aperture 32. Lateral gas inlet 30 is in fluid communication with gas inlet conduit 24 through apertures 32 and 34. Boss 28 may be made of, for example, brass.

Coupling 26 also includes an insulating plate 36, which is made of an electrically insulating material, such as "BAKELITE", epoxy, or polymethacrylate. Insulating plate 36 is attached to boss 28 by, for example, screws 38. Preferably, an "O" ring 40 is interposed between insulating plate 36 and boss 28 to provide a sealed fit.

Coupling 26 further includes an end plate 42 made of, for example, brass. End plate 42 is attached to insulating plate 36 by, for example, the bolts 44 and nuts 46. Preferably, to seal end plate 42 to insulating plate 36 an "O" ring 48 is interposed therebetween.

Insulating plate 36 and end plate 42 each include an aperture through which a ram 50 is slidably inserted. Preferably, to seal the interface between ram 50 and the aperture of insulating plate 36, and "O" ring 52 is interposed therebetween. Ram 50 may be made of any high-temperature corrosion resistant material, such as "INCONEL".

A crucible support platform 54 is supported by the upper end of ram 50. Crucible support platform 54 may be made of any high-temperature corrosion resistant material, such as "INCONEL". A crucible 56 sits on the crucible support platform 54, and preferably a drip tray 58 is interposed therebetween. Crucible 56 may be made of, for example, nickel.

A furnace 60 is concentrically mounted about peripheral wall 14 and below bottom wall 16 of reactor chamber 12. Furnace 60 may include, for example, conventional electric resistance heating elements (not shown). Preferably, furnace 60 also surrounds a portion of gas inlet conduit 24 adjacent to reactor chamber 12.

Because ram 50 is slidably received in the apertures of insulating plate 36 and end plate 42, crucible support platform 54 and crucible 56 may be raised and lowered within reactor chamber 12 for servicing. The position of ram 50 may be changed, for example, by a hydraulic cylinder, a lead screw, or the like. Alternatively, ram 50 may be fixed to end plate 42, wherein the aperture in end plate 42 is omitted and ram 50 is attached by screws, for example.

Cover 18 of reactor chamber 12 is provided with electrode fittings 62, through which cathode 64, reference electrode 66 and anode 68 extent downward into crucible 56. Electrode fittings 62 may be, for example, conventional vacuum-seal "TEFLON" insulators. Cover 18 of reactor chamber 12 also includes a thermocouple fitting 70, through which a thermocouple 72 extends downward into crucible 56. Thermocouple fitting 70 may be, for example, a conventional vacuum-seal "TEFLON" insulator. Thermocouple 72 is used to measure the temperature of the salt melt within crucible 64. A workpiece 74 to be coated is attached to cathode 64.

A gas outlet 76 is also provided in cover 18 of reactor chamber 12. Alternatively, gas outlet 76 may be provided in an upper portion of peripheral wall 14 of reactor chamber 12. Water cooling coils 78 cool flange 20 (including the o-ring) and cover 18 as well as the fittings for cathode 64, reference electrode 66, anode 68 and thermocouple 72, preferably to below 200° C., to avoid damage to the rubber "O" ring seal interposed between flange 20 and cover 18, and the "TEFLON" electrode fittings 62 and thermocouple fitting 70.

The present invention may be scaled-up beyond a glove box-sized apparatus, e.g., sized for a pilot plant or for an industrial plant. For example, in a pilot-plant-scale molten salt reactor according to the present invention, the inside diameter of the peripheral wall 14 of reactor chamber 12 may be about 6 inches, crucible 56 may have an inside diameter of about 4.5–5 inches so as to hold approximately 1 kg of molten salt, and gas inlet conduit 24 may have an inside diameter of about 1–3 inches. An industrial scale molten salt reactor would have a much larger diameter.

A molten salt reactor for potentiostatic electroplating according to the present invention may be used to carry out electrodeposition of refractory compounds.

For example, to carry out electrodeposition of refractory metal silicides according to the present invention, an essentially pure alkali fluoride melt is first prepared in crucible 56. Silicon is added to the melt in the form of silicon fluoride ($K_2SiF_6$) and the refractory metal to be electrodeposited is added to the melt in the form of a soluble metal fluoride. An elemental form of silicon or the refractory metal is placed in the melt as anode 68. Workpiece 74 is attached to cathode 64 and is also placed into the melt. A platinum wire is placed into the melt as reference electrode 66. Electrolysis is then carried out potentiostatically in the traditional manner until workpiece 74 has the desired thickness of coating on its surface. Virtually any thickness of coating may be deposited according to the present invention.

Preferably, the alkali fluoride melt is composed of a eutectic mixture of more than one alkali fluoride. Examples of such melts include, but are not limited to, the eutectic mixtures KF:LiF; NaF:KF; NaF:LiF; and LiF:NaF:KF (hereinafter FLINAK). Preferably, the melt is composed of FLINAK. In accordance with established methods, the melt should be essentially pure and dry. Impurities can be removed from the FLINAK by well known methods such as preelectrolysis. To prevent impurities from entering into molten salt reactor 10, electrodeposition is carried out in a water-free and oxygen-free slow-flowing inert atmosphere typically of argon, in accordance with established methods. To reduce the amount of diffusion of silicon into the cathode metal, cathode 64 should be comprised of a metal which does not alloy with silicon, e.g., tantalum or silver. If a metal which does alloy with silicon is used, a prior coating of a metal which does not alloy with the cathode metal may be electrodeposited according to methods well known in the art as a barrier layer to eliminate this problem. For example, a tantalum barrier layer may be used where a tantalum silicide coating is desired.

The preferred source of silicon is $K_2SiF_6$. Preferably, anywhere from 5–10 weight percent silicon ion, based on the weight of the alkali fluoride melt, can be added in the mixture. The silicide of any refractory metal should be capable of being electrodeposited. Of course, certain routine and conventional adjustments to parameters such as voltage, temperature, percentage of silicon and percentage of metal containing compound, may be required. The preferred refractory metals to be used are tantalum, titanium, tungsten, molybdenum, chromium, hafnium, niobium, zirconium.

The preferred metal containing compound is a refractory metal fluoride. Most preferably it is $K_2TaF_7$ where a tantalum silicide coating is desired, and $K_2TiF_7$ where a titanium silicide coating is desired. Anode 68 is comprised of the refractory metal or silicon, e.g., a tantalum or silicon anode is used where a tantalum silicide coating is desired, and a titanium or silicon anode is used where a titanium silicide coating is desired. The reference electrode can be any material useful as a reference electrode in potentiostatic electroplating.

The voltage applied is not critical to successful deposition. However, too high a voltage may cause decomposition of the fluoride melt. Generally, voltages below 1.2 Volts are preferred. Current density merely controls the rate of coating deposition. The temperature of the salt melt in the crucible 56 must be well above the melting point of the salt melt and is normally between about 700° and 900° C., most typically at about 750° C. Temperatures over about 800° C. may interfere with deposition by increasing the evaporation rate of various components of the mixture.

To carry out electrodeposition of refractory metal carbides according to the present invention, an essentially pure alkali fluoride melt is first prepared in crucible 56. Carbon is added to the melt in the form of an alkali carbonate, and the refractory metal to be electrodeposited is added to the melt in the form of a soluble-metal containing compound. The elemental form of the refractory metal is placed into the melt as anode 68. Workpiece 74, attached to cathode 64, e.g., nickel, is also placed into the melt. A platinum wire is placed into the melt as reference electrode 66. Electrolysis is then carried out potentiostatically in the traditional manner until workpiece 74 has the desired thickness of coating on its surface. Virtually any thickness of coating may be deposited by the present invention.

Preferably, the alkali fluoride melt is composed of a eutectic mixture of more than one alkali fluoride, at least one of which wherein the alkali metal is potassium. Examples of such melts include, but are not limited to, the eutectic mixtures KF:LiF; NaF:KF; NaF:LiF; and FLINAK. Most preferably, the melt is composed of FLINAK. In accordance with established methods, the melt should be essentially pure and dry. Impurities can be removed by well-known methods such as pre-electrolysis. To prevent impurities from entering into molten salt reactor 10, electrodeposition is carried out in a slow-flowing inert atmosphere typically argon, in accordance with established methods.

The preferred sources of carbon are sodium carbonate and potassium carbonate. The most preferred source of carbon is potassium carbonate. Preferably anywhere from about 0.6 to 6 weight percent carbonate ion, based on the weight of the alkali fluoride melt, can be added to the mixture. The exact amount of carbonate ion used will vary depending upon the desired stoichiometry of the coating. The carbide of any refractory metal should be capable of being electrodeposited according to the process of this invention. Of course, certain routine adjustments to parameters such as voltage, temperature, percentage of carbon, and percentage of metal-containing compound may be required. The preferred refractory metals to be used as the anode are tantalum, tungsten, molybdenum, chromium, hafnium, niobium, and titanium.

Preferably, the soluble metal-containing compound is a fluoride salt of the refractory metal. Nevertheless, where tungsten is the refractory metal, the preferred metal-containing compound is sodium tungstate. It is believed that in the melt, the sodium tungstate forms a fluoride which forms a stable complex ion. When the refractory metal is tantalum, the preferred metal-containing compound is $K_2TaF_7$.

The weight percentage of the metal-containing compound is not critical to successful electrodeposition of the tungsten carbide coating, so long as the amount of compound used is soluble in the melt. Preferably, about 1–10 weight percent of metal-containing compound is added to the melt, based on the weight of the melt. Likewise, the voltage applied is not critical to successful electrodeposition. However, too high of a voltage may cause decomposition of the fluoride melt. Generally, a range of about 0.1 to 2.0 Volts is sufficient. A voltage below 1.5 Volts is most preferred. Current density merely controls the rate of coating deposition.

The stoichiometric composition of the coating may be controlled by varying the parameters of voltage, weight percent carbonate ion and weight percent metal-containing compound. Surprisingly, temperature had negligible influence. Nevertheless, the temperature of the salt melt in the crucible 56 must be well above the melting point of the salt melt and is normally about 700° to 850° C. and most typically about 750° C. Temperatures over about 850° C. may interfere with electrodeposition by increasing the evaporation rate of various components of the mixture.

Because of the voltage sensitivity of electrodeposition of refractory metal carbides and silicides, a three-electrode (potentiostatic) plating process is used, in which the voltage between cathode 64 and reference electrode 66 is controlled. No current passes through reference electrode 66, however.

The inert gas, for example, argon, flows from lateral gas inlet 30, through apertures 34, 32, through gas inlet conduit 24, through opening 22, past crucible 56, and exits from gas outlet 76. Thus, the inert gas is introduced from below crucible support platform 54 and crucible 56. Therefore, the inert gas is heated before it comes into contact with the vapors from crucible 56, since the inert gas first passes through a portion of gas inlet conduit 24 that is heated by furnace 60. This has the advantage of reducing salt condensation within the hot zone of the reactor and, consequently, deposition of, vaporized salt from crucible 56 in the regions of reactor chamber 12 and gas inlet conduit 24 heated by furnace 60. If salt is deposited in the portion of gas inlet conduit 24 which is not heated by furnace 60 or on the cover 18, the temperature thereof is such that the salt is not electrically conductive. To reduce the time needed for the removal of air from the system, it may also be desirable to evacuate the system before flowing gas therethrough and starting the plating process.

Moreover, because crucible support platform 54 does not electrically contact reaction chamber 12, potentiostatic plating is possible. Consequently, potentiostatic electroplating may be carried out in a molten salt reactor having any desired scale, according to the present invention.

Numerous modifications and adaptations of the present invention will be apparent to those skilled in the art and thus, it is intended by the following claims to cover all modifications and adaptations which fall within the true spirit and scope of the invention.

What is claimed is:

1. A molten salt reactor for potentiostatic electroplating, comprising:

a reactor chamber including a peripheral wall, a bottom wall having an opening, an upper portion, a lower portion and a cover at a top of said upper portion;

a gas inlet conduit attached to said bottom wall of said reactor chamber and in fluid communication with said reactor chamber through said opening;

a gas outlet, in fluid communication with said reactor chamber, in an upper portion of said reactor chamber;

a furnace substantially surrounding said peripheral wall of said reactor chamber;

a crucible support platform positioned within said reactor chamber; and insulating means for electrically insulating said crucible support platform from said reactor chamber.

2. A molten salt reactor as recited in claim 1, wherein said reactor is adapted to flow an inert gas from said gas inlet conduit, through said lower portion of said reactor chamber that includes said bottom wall, past said crucible support platform, through said upper portion of the reactor chamber that includes said cover, and through said gas outlet in said upper portion of said reactor chamber.

3. A molten salt reactor as recited in claim 2, wherein:

said furnace substantially surrounds a portion of said gas inlet conduit adjacent to said reactor chamber; and said gas inlet conduit is adapted to heat said flow of inert gas prior to the flow of said inert gas into said lower portion of said reactor chamber.

4. A molten salt reactor as recited in claim 1 wherein:

said gas inlet conduit includes a lateral gas inlet having an axis substantially perpendicular to an axis of said gas inlet conduit.

5. A molten salt reactor as recited in claim 1, wherein:

said crucible support platform is supported by a shaft extending into said gas inlet conduit.

6. A molten salt reactor as recited in claim 5, wherein:

said insulating means includes an insulator attached to said gas inlet conduit and interposed between said shaft and said gas inlet conduit.

7. A molten salt reactor as recited in claim 6, wherein said insulator includes an aperture, and said shaft is slidably received in said aperture.

8. A molten salt reactor for potentiostatic electroplating, comprising:

a reactor chamber including a cylindrical wall, a bottom wall having an opening concentric within said cylindrical wall, an upper portion, a lower portion and a cover at a top of said upper portion;

a gas inlet conduit having a first end attached to said bottom wall of said reactor chamber and in fluid communication with said reactor chamber through said opening and concentric with said cylindrical wall of said reactor chamber;

a gas outlet, in fluid communication with said reactor chamber, in an upper portion of said reactor chamber;

a furnace substantially surrounding said cylindrical wall of said reactor chamber and said first end of said gas inlet conduit;

a crucible support platform positioned within said reactor chamber; and insulating means for electrically insulating said crucible support platform from said reactor chamber.

9. A molten salt reactor as recited in claim 8, wherein said gas inlet conduit includes a second end, and said molten salt reactor further comprising:

a boss attached to said second end of said inlet conduit and having a first aperture concentric with said gas inlet conduit, said boss including a lateral gas inlet having an axis substantially perpendicular an axis of said first aperture and being in fluid communication with said gas inlet conduit through said first aperture.

10. A molten salt reactor as recited in claim 9, wherein:

said insulating means includes an insulating plate attached to said boss and having a second aperture concentric with said first aperture, said second aperture having a smaller diameter than said first aperture.

11. A molten salt reactor as recited in claim 10, further comprising:

an end plate attached to said insulating plate and having a third aperture concentric with said second aperture, said third aperture having approximately the same diameter as said second diameter; and a shaft supporting said crucible support platform, said shaft extending through said gas inlet conduit and said boss, and slidably received in said first and second apertures.

12. A molten salt reactor as recited in claim 8, wherein said gas inlet conduit includes a second end, and wherein said reactor is adapted to flow an inert gas from said second end of said gas inlet conduit, through said first end of said gas inlet conduit, and into said reaction chamber;

said gas inlet conduit is adapted so that said inert gas is at a first temperature in said second end of said gas inlet conduit, said first temperature being less than a temperature at which a molten salt to be reacted in said reaction chamber is conductive; and said inert gas is adapted to be heated by said furnace to a second temperature in said first end of said gas inlet conduit, said second temperature being higher than said first temperature.

13. A molten salt reactor for potentiostatic electroplating, comprising:

a reactor chamber including a peripheral wall, a bottom wall having an opening, an upper portion, a lower portion and a cover at a top of said upper portion, said cover having at least one electrode fitting;

a crucible support platform positioned within said reactor chamber;

a crucible mounted on said crucible support platform, said crucible being adapted for containing an alkali fluoride melt;

an anode exiting said reactor chamber through said at least one electrode fitting said anode being adapted to be immersed in an alkali fluoride melt in said crucible;

a cathode exiting said reactor chamber through said at least one electrode fitting, said cathode including an object to be coated and being adapted to be immersed in an alkali fluoride melt in said crucible;

a reference electrode exiting said reactor chamber through said at least one electrode fitting, said reference electrode being adapted to be immersed in an alkali fluoride melt in said crucible;

a gas inlet conduit attached to said bottom wall of said reaction chamber and in fluid communication with said reactor chamber through said gas inlet opening;

a gas outlet, in fluid communication with said reactor chamber, in an upper portion of said reactor chamber;

a furnace substantially surrounding said peripheral wall of said reactor chamber; and insulating means for electrically insulating said crucible support platform from said reactor chamber.

14. A molten salt reactor as recited in claim 13, wherein said cover of said reactor chamber further includes:

cooling coils surrounding said at least one electrode fitting.

15. A molten salt reactor as recited in claim 13, wherein said cover of said reactor chamber includes a thermocouple fitting, and said molten salt reactor further comprising:

a thermocouple exiting said reactor chamber through said thermocouple fitting, said thermocouple being adapted to be immersed in an alkali fluoride melt in said crucible.

* * * * *